US006207633B1

(12) United States Patent
Kettenacker et al.

(10) Patent No.: US 6,207,633 B1
(45) Date of Patent: Mar. 27, 2001

(54) GRANULAR DETERGENT COMPOSITION CONTAINING AN OPTIMUM SURFACTANT SYSTEM FOR COLD TEMPERATURE LAUNDERING

(75) Inventors: Darla Bonar Kettenacker, Edgewood, KY (US); Eugene Joseph Pancheri, Montgomery, OH (US); Jacqueline Westfield, Walton, KY (US); Rose Marie Weitzel, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/446,215

(22) PCT Filed: Jun. 12, 1998

(86) PCT No.: PCT/IB98/00927

§ 371 Date: Dec. 16, 1999

§ 102(e) Date: Dec. 16, 1999

(87) PCT Pub. No.: WO98/59024

PCT Pub. Date: Dec. 30, 1998

Related U.S. Application Data

(60) Provisional application No. 60/050,526, filed on Jun. 23, 1997.

(51) Int. Cl.[7] ..... C11D 1/37; C11D 1/62; C11D 1/65

(52) U.S. Cl. ..... 510/352; 510/276; 510/290; 510/308; 510/329; 510/352; 510/357; 510/426; 510/428; 510/443; 510/498; 510/504; 510/509; 510/510; 510/511; 510/531

(58) Field of Search ..... 510/276, 290, 510/308, 329, 352, 357, 426, 428, 443, 498, 504, 509, 510, 511, 531

(56) References Cited

U.S. PATENT DOCUMENTS

| | | | | |
|---|---|---|---|---|
| 3,936,537 | * | 2/1976 | Baskerville, Jr. et al. | 427/242 |
| 4,338,204 | * | 7/1982 | Spadini et al. | 252/8.75 |

FOREIGN PATENT DOCUMENTS

| | | | |
|---|---|---|---|
| 0 051 986 A2 | 5/1982 | (EP) | C11D/1/86 |
| 2 292 155 | 2/1996 | (GB) | C11D/1/86 |
| WO 95/23205 | 8/1995 | (WO) | C11D/3/34 |

* cited by examiner

*Primary Examiner*—Yogendra Gupta
*Assistant Examiner*—Charles Boyer
(74) *Attorney, Agent, or Firm*—Marianne Dressman; Kim William Zerby; Steven W. Miller

(57) ABSTRACT

A granular detergent composition which includes a surfactant system containing linear alkylbenzene sulfonate, acyclic quaternary ammonium salt, alkyl sulfate and alkyl ethoxy sulfate surfactants in selected molar ratios is provided. The composition has improved performance in cold temperature (i.e., 5° C. to 30° C.) laundering operations.

20 Claims, No Drawings

GRANULAR DETERGENT COMPOSITION CONTAINING AN OPTIMUM SURFACTANT SYSTEM FOR COLD TEMPERATURE LAUNDERING

This application claims the benefit of Ser. No. 60/050,526 filed Jun. 23, 1997

FIELD OF THE INVENTION

The invention generally relates to granular detergent compositions used in cold temperature laundering operations (i.e., 5° C. to 30° C.). More particularly, the invention is directed to a granular detergent composition which contains an optimally selected surfactant system in which linear alkylbenzene sulfonate surfactants are contained in selected molar ratios with other surfactants such as alkyl sulfates, alkyl ethoxy sulfates, and cationic surfactants. The resulting detergent compositions unexpectedly exhibits superior cleaning performance, especially at low wash water temperatures.

BACKGROUND OF THE INVENTION

Typically, conventional detergent compositions contain mixtures of various surfactants in order to remove a wide variety of soils and stains from surfaces of articles to be laundered. Currently, formulators of detergent compositions used for cold water laundering operations generally incorporate high levels of linear alkylbenzene sulfonate surfactant into their detergent products since they are very effective in both cold and hot water wash conditions.

The linear alkylbenzene sulfonate surfactants have also been utilized frequently for their ability to provide excellent cleaning of grease and oil stains. Combinations of linear alkylbenzene sulfonate surfactants and adjunct surfactants such as alkyl sulfate surfactants are desirable because they combine the excellent grease and oil cleaning of linear alkylbenzene sulfonate (along with good cleaning across a broad range of stain types) with the excellent particulate soil removal performance of alkyl sulfate surfactants and the like. Whereas alkyl sulfate surfactants are readily derived from renewable resources, it would be desirable to provide a detergent composition that could provide comparable or improved cleaning performance wherein the linear alkylbenzene sulfonate surfactants was either partially or completely replaced with adjunct surfactants that could easily be made from natural, renewable, non-petroleum raw materials and which clean a wider variety of stains and soils.

However, one formidable problem associated with alkyl sulfate surfactants is that they do not perform extremely well under cold temperature washing conditions. Such alkyl sulfate surfactants experience poor dissolution in the wash liquor when included at significant levels which naturally leads to poor cleaning performance. Thus, total replacement or significant replacement of the linear alkylbenzene sulfonate surfactants has been difficult. Such problems have also been experienced with other surfactants such as cationic surfactants and alkyl ethoxy sulfate surfactants. A substantial portion of the consumers in the world are left with little choice other than laundering their soiled clothes in cold temperature wash waters which can have large amounts of water hardness (e.g. North America), both of which severely restrict formulation flexibility with regard to adjunct surfactant use with linear alkylbenzene sulfonate surfactant-based detergent products. As a consequence, it would be desirable to have a detergent composition which contains an optimally performing surfactant system containing linear alkylbenzene sulfonate surfactant along with other surfactants resulting in improved cleaning in cold temperature laundering operations.

Accordingly, it would be desirable to have a granular detergent composition which exhibits superior performance under cold temperature (i.e., 5° C. to 30° C.) laundering. It would also be desirable to have such a detergent composition which includes substantially renewable or more biodegradable components in the surfactant system and which can clean a wider variety of stains and soils while also exhibiting improved cleaning performance.

BACKGROUND ART

U.S. Pat. No. 5,512,699 to Conner et al discloses a variety of detergent compositions containing a multitude of detersive surfactants.

SUMMARY OF THE INVENTION

The invention meets the needs identified above by providing a granular detergent composition which includes a surfactant system containing linear alkylbenzene sulfonate, acyclic quaternary ammonium salt, alkyl sulfate and alkyl ethoxy sulfate surfactants in selected molar ratios which results in unexpectedly superior cleaning performance in cold temperature (i.e., 5° C. to 30° C.) laundering operations. The granular detergent composition of the invention incorporates linear alkylbenzene sulfonate surfactant with adjunct surfactants such as alkyl sulfate which clean a wider variety of stains and soils and which are more biodegradable to provide an detergent composition that retains or improves performance under cold temperature wash conditions which have been traditionally difficult for such surfactant systems.

In accordance with one aspect of the invention, a granular detergent product having improved performance is provided. The granular detergent composition comprises: (a) from about 1% to about 90% by weight of a surfactant system including (i) acyclic quaternary ammonium salt surfactant and linear alkylbenzene sulfonate surfactant in a molar ratio range of from about 1:8 to about 1:72, wherein said quaternary ammonium salt surfactant has the formula

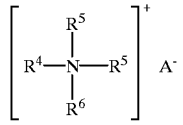

wherein $R^4$ is an acyclic aliphatic $C_{10}$–$C_{22}$ hydrocarbon group, $R^5$ is $R^4$ or $C_1$–$C_4$ saturated alkyl or hydroxy alkyl groups, and $R^6$ is $R^4$ or $R^5$ and $A^-$ is an anion; (ii) alkyl sulfate surfactant in a molar ratio range with the linear alkylbenzene sulfonate surfactant of from about 1:3 to about 1:20; (iii) alkyl ethoxy sulfate surfactant in a molar ratio range with the linear alkylbenzene sulfonate surfactant of from about 1:15 to about 1:42, wherein the alkyl ethoxy sulfate surfactant has a degree of ethoxylation of from about 1 to 5; (b) at least about 1% by weight of a detergency builder; and (c) the balance adjunct detergent ingredients.

In accordance with another aspect of the invention, a highly preferred granular detergent composition is provided. The granular detergent composition comprises: (a) from about 5% to about 40% by weight of a surfactant system including (i) acyclic quaternary ammonium salt surfactant and linear alkylbenzene sulfonate surfactant in a molar ratio of from about 1:10 to about 1:63, wherein said quaternary ammonium salt surfactant has the formula

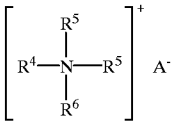

wherein $R^4$ is an acyclic aliphatic $C_{10}$–$C_{22}$ hydrocarbon group, $R^5$ is $R^4$ or $C_{1-C4}$ saturated alkyl or hydroxy alkyl groups, and $R^6$ is $R^4$ or $R^5$ and $A^-$ is an anion; (ii) alkyl sulfate surfactant in a molar ratio range with the linear alkylbenzene sulfonate surfactant of from about 1:5 to about 1:15; (iii) alkyl ethoxy sulfate surfactant in a molar ratio range with the linear alkylbenzene sulfonate surfactant of from about 1:20 to about 1:35, wherein the alkyl ethoxy sulfate surfactant has a degree of ethoxylation of from about 1 to 5; (b) from about 10% to about 70% by weight of a detergency builder; and (c) the balance adjunct detergent ingredients.

Also provided are methods of laundering soiled clothes comprising the step of contacting the clothes with an effective amount of a granular detergent composition as described herein in an aqueous solution. All percentages and ratios used herein are expressed as percentages by weight (anhydrous basis) unless otherwise indicated. All documents are incorporated herein by reference.

Accordingly, it is an object of the invention to provide a granular detergent composition which exhibits superior performance in cold temperature laundering operations. It is also an object of the invention to provide such a detergent composition which includes substantially renewable or more biodegradable components in the surfactant system and which can clean a wider variety of stains and soils while also exhibiting improved cleaning performance. These and other objects, features and attendant advantages of the present invention will become apparent to those skilled in the art from a reading of the following detailed description of the preferred embodiment and the appended claims.

DETAILED DESCRIPTION OF THE PREFERRED EMBODIMENT

The granular detergent composition essentially contains a surfactant system having linear alkylbenzene sulfonate ("LAS"), acyclic quaternary ammonium salt ("AQAS"), alkyl sulfate ("AS") and alkyl ethoxy sulfate ("AES") surfactants and a detergent builder. Typical adjunct detergent ingredients can also be included in the detergent composition. The invention is concerned primarily with an especially selected surfactant system which unexpectedly strikes a balance between LAS surfactant and adjunct surfactants which include AES, AS and AQAS.

While not intending to be bound by theory, it is believed that the present invention selects amounts of AES, AS and AQAS expressed as molar ratios of LAS to result in a granular composition which unexpectedly has improved water dissolution, and therefore enhanced cleaning performance. In the past, inclusion of adjunct surfactants such as AES, AS and AQAS with LAS alone or in combination would either result in poor dissolution or poor cleaning of all of the typical stains and soils. However, the present invention involves the unexpected discovery that by using selected adjunct surfactants (i.e., AES, AS, and AQAS) with LAS surfactant at selected molar ratios, a composition having overall improved cleaning performance and dissolution across a variety of stain and soils can be produced.

To that end, the molar ratio of AQAS to LAS is preferably from about 1:8 to about 1:72, more preferably from about 1:10 to about 1:63, and most preferably from about 1:15 to about 1:42. The molar ratio of AS to LAS is preferably from about 1:3 to about 1:20, more preferably from about 1:5 to about 1:15, and most preferably from about 1:8 to about 1:12. The molar ratio of AES to LAS is preferably from about 1:15 to about 1:42, more preferably from about 1:20 to about 1:35, and most preferably from about 1:24 to about 1:30. The preferred LAS is $C_{10-18}$ linear alkylbenzene sulfonate, and the preferred AQAS is $C_{12-14}$ dimethyl hydroxyethyl quatemary ammnonium chloride (or wherein $R^4$ is an acyclic aliphatic $C_{12}$–$C_{14}$ hydrocarbon group, $R^5$ is a methyl group, $R^6$ is a hydroxyethyl group and $A^-$ is a chloride anion in the aforementioned chemical formula), although other quaternary ammonium salts may be used as detailed hereinafter. Even more preferably, the molar ratio of LAS surfactant to the sum of the AS surfactant, the AES surfactant and the AQAS surfactant is greater than about 1:1.

The overall surfactant system is present in the composition in an amount of from about 1% to about 90%, preferably from about 5% to about 40%, more preferably from about 10% to about 30% by weight. Additionally, a detergent builder is included in the composition at levels of at least about 1%, preferably from about 10% to about 70%, and most preferably from about 20% to about 50% by weight of the composition. Preferably, the composition is substantially free of phosphate builders. The granular composition also preferably includes adjunct detergent ingredients selected from the group consisting of bleaching agents, bleach activators, enzymes, polymeric anti-redeposition agents, polymeric dispersants, polymeric soil release agents, chelants, perfumes, dye transfer inhibitors and mixtures thereof. Highly preferred compositions include from about 10% to about 30% of sodium carbonate, from about 20% to about 40% of sodium sulfate, from about 1% to about 10% of sodium polyacrylate, from about 0.1% to about 5% of a bleaching agent and bleach activator, and 0.1% to about 5% of enzymes selected from the group consisting of proteases, cellulases, lipases, amylases and mixtures thereof. Optionally, the composition includes alkyl ethoxylate ("AE") in a molar ratio range with the LAS surfactant of less than about 1:10, preferably from about 1:1 to about 1:24. Preferably, the AE surfactant is $C_{12-13}$ alkyl ethoxylate with a degree of ethoxylation of from about 2 to about 9.

Surfactant System

As described previously, the surfactant system of the composition preferably includes LAS, AS, AES and AQAS, and optionally, AE surfactants. It should be understood that additional surfactants as described herein may be added to the composition andlor similar types of surfactants may be substituted for one or more of the surfactants listed herein. Additional detergent surfactants useful herein are described in U.S. Pat. No. 3,664,961, Norris, issued May 23, 1972, and in U.S. Pat. No. 3,919,678, Laughlin et al., issued Dec. 30, 1975, both of which are incorporated herein by reference.

Examples of useful AQAS surfactants are the monoalkyl trimethylammonium salts such as mono allow trimethyl ammonium chloride, mono(hydrogenated tallow) trimethylammonium chloride, palmityltrimethyl ammonium chloride and soyatrimethylammonium chloride, sold by Witco Chemical Company under the trade name Adogen® 471, Adogen® 441, Adogen® 444, and Adogen® 415, respectively. In these salts, $R^4$ is an acyclic aliphatic $C_{16}$–$C_8$ hydrocarbon group, and $R^5$ and $R^6$ are methyl groups. Mono(hydrogenated tallow)trimethylammonium chloride and monotallowtrimethylammonium chloride are preferred. Further examples include dialkyldi methylammonium salts such as ditallowdimethylamrnmonium chloride. Examples of commercially available dialkyldimethyl ammonium salts usable in the present invention are di(hydrogenated tallow) dimethylammonium chloride (trade name Adogen® 442), ditallowdimethyl ammonium chloride (trade name Adogen® 470), distearyl dimethylammonium chloride (trade name Arosurf® TA-100), all available from Witco Chemical Company, dimethylstearylbenzyl ammonium chloride sold under the trade names Varisoft® SDC by Witco Chemical Company and Anvuonyx® 490 by Onyx Chemical Company. Also preferred are those selected from the group consisting of di(hydrogenated tallow) dimethylanmmonium chloride, ditallowdimethylammonium chloride. Additional examples include N,N-dimethyl-N lauryl-(2-hydroxyethyl) ammonium chloride, N,N-dimethyl-N-myristyl-(2-hydroxyethyl) ammonium chloride, N,N-dimethyl-N-cocyl-(2-hydroxyethyl) ammonium chloride, N,N-dimethyl-N-tallow-(2-hydroxyethyl) ammonium chloride. Mixtures of the above examples are also included within the scope of the present invention.

In the cationic nitrogenous salts described hereinbefore, the anion $A^-$ provides charge neutrality. Most often, the anion used to provide charge neutrality in these salts is a halide, such as chloride or bromide. However, other anions can be used, such as methylsulfate, ethylsulfate, hydroxide, acetate, formate, citrate, sulfate, carbonate, and the like. Chloride and methylsulfate are preferred herein as anion $A^-$. Other useful cationic surfactants also include those described in U.S. Pat. No. 4,222,905, Cockrell, issued Sept. 16, 1980, and in U.S. Pat. No. 4,239,659, Murphy, issued Dec. 16, 1980, both of which are also incorporated herein by reference. Of the surfactants, no nionics and nonionics are preferred and anionics are most preferred.

Nonlimiting examples of the preferred anionic surfactants useful herein include the conventional $C_{11}$–$C_{18}$ alkyl benzene sulfonates, primary, branched-chain and random $C_{10}$–$C_{20}$ alkyl sulfates, the $C_{10}$–$C_{18}$ secondary (2,3) alkyl sulfates of the formula $CH_3(CH_2)_x(CHOSO_3^-M^+)$ $CH_3$ and $CH_3$ $(CH2)_y(CHOSO_3^-M^+)$ $CH_2CH_3$ where x and (y+1) are integers of at least about 7, preferably at least about 9, and M is a water-solubilizing cation, especially sodium, unsaturated sulfates such as oleyl sulfate, and the $C_{10}$–$C_{18}$ alkyl alkoxy sulfates ("$AE_xS$"; especially EO 1–7 ethoxy sulfates).

Optionally, other exemplary surfactants useful include and $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid anides, such as $C_{10}$–$C_{18}$ N-(3-nethoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

Adiunct Builders

One or builders can be used to improve the performance of the compositions described herein. For example, the builder can be selected from the group consisting of aluminosilicates, crystalline layered silicates, MAP zeolites, citrates, amorphous silicates, polycarboxylates, sodium carbonates and mixtures thereof. Another particularly suitable option is to include amorphous material coupled with the crystalline microstructures in the builder material. In this way, the builder material includes a "blend" of crystalline microstructures and amorphous material or microstructures to give improved builder performance. Other suitable builders are described hereinafter.

Preferred builders include aluminosilicate ion exchange materials and sodium carbonate. The aluminosilicate ion exchange materials used herein as a detergent builder preferably have both a high calcium ion exchange capacity and a high exchange rate. Without intending to be limited by theory, it is believed that such high calcium ion exchange rate and capacity are a function of several interrelated factors which derive from the method by which the alurninosilicate ion exchange material is produced. In that regard, the aluminosilicate ion exchange materials used herein are preferably produced in accordance with Corkill et al, U.S. Pat. No. 4,605,509 (Procter & Gamble), the disclosure of which is incorporated herein by reference.

Preferably, the aluminosilicate ion exchange material is in "sodium" form since the potassium and hydrogen forms of the instant aluminosilicate do not exhibit the as high of an exchange rate and capacity as provided by the sodium form. Additionally, the aluminosilicate ion exchange material preferably is in over dried form so as to facilitate production of crisp detergent agglomerates as described herein. The aluminosilicate ion exchange materials used herein preferably have particle size diameters which optimize their effectiveness as detergent builders. The term "particle size diameter" as used herein represents the average particle size diameter of a given aluminosilicate ion exchange material as determined by conventional analytical techniques, such as microscopic determination and scanning electron microscope (SEM). The preferred particle size diameter of the aluminosilicate is from about 0.1 micron to about 10 microns, more preferably from about 0.5 microns to about 9 microns. Most preferably, the particle size diameter is from about 1 microns to about 8 microns.

Preferably, the aluminosilicate ion exchange material has the formula $$Na_z[(AlO^2)_z.(SiO_2)y]xH_2O$$

wherein z and y are integers of at least 6, the molar ratio of z to y is from about 1 to about 5 and x is from about 10 to about 264. More preferably, the aluminosilicate has the formula $$Na_{12}[(AlO_2)_{12}.(SiO_2)_{12}]xH_2O$$

wherein x is from about 20 to about 30, preferably about 27. These preferred alumino-silicates are available commercially, for example under designations Zeolite A, Zeolite B and Zeolite X. Alternatively, naturally-ocurring or synthetically derived aluminosilicate ion exchange materials suitable for use herein can be made as described in Krummel et al, U.S. Pat. No. 3,985,669, the disclosure of which is incorporated herein by reference.

The aluminosilicates used herein are further characterized by their ion exchange capacity which is at least about 200 mg equivalent of $CaCO_3$ hardness/gram, calculated on an anhydrous basis, and which is preferably in a range from about 300 to 352 mg equivalent of $CaCO_3$ hardness/gram. Additionally, the instant aluminosilicate ion exchange materials are still further characterized by their calcium ion exchange rate which is at least about 2 grains Ca++/gallon/minute/-gram/gallon, and more preferably in a range from about 2 grains Ca++/gallon/minute/-gramn/gallon to about 6 grains Ca++/gallon/minute/-gram/gallon .

Adjunct Detergent Ingredients

Adjunct ingredients include other detergency builders, bleaches, bleach activators, suds boosters or suds suppressors, anti-tamish and anticorrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference.

Other builders can be generally selected from the various water-soluble, alkali metal, ammoniumn or substituted anmmonium phosphates, polyphosphates, phosphonates, polyphosphonates, carbonates, borates, polyhydroxy sulfonates, polyacetates, carboxylates, and polycarboxylates. Preferred are the alkali metal, especially sodium, salts of the above. Preferred for use herein are the phosphates, carbonates, $C_{10-18}$ fatty acids, polycarboxylates, and mixtures thereof. More preferred are sodium tripolyphosphate, tetrasodium pyrophosphate, citrate, tartrate mono- and di-succinates, and mixtures thereof (see below).

In comparison with amorphous sodium silicates, crystalline layered sodium silicates exhibit a clearly increased calcium and magnesium ion exchange capacity. In addition, the layered sodium silicates prefer magnesium ions over calcium ions, a feature necessary to insure that substantially all of the "hardness" is removed from the wash water. These crystalline layered sodium silicates, however, are generally more expensive than amorphous silicates as well as other builders. Accordingly, in order to provide an economically feasible laundry detergent, the proportion of crystalline layered sodium silicates used must be determined judiciously.

The crystalline layered sodium silicates suitable for use herein preferably have the formula $$NaMSi_xO_{2x+1}.yH_2O$$

wherein M is sodium or hydrogen, x is from about 1.9 to about 4 and y is from about 0 to about 20. More preferably, the crystalline layered sodium silicate has the formula $$NaMSi_2O_5.yH_2O$$

wherein M is sodium or hydrogen, and y is from about 0 to about 20. These and other crystalline layered sodium silicates are discussed in Corkill et al, U.S. Pat. No. 4,605,509, previously incorporated herein by reference.

Specific examples of inorganic phosphate builders are sodium and potassium tripolyphosphate, pyrophosphate, polymeric metaphosphate having a degree of polymerization of from about 6 to 21, and orthophosphates. Examples of polyphosphonate builders are the sodium and potassium salts of ethylene diphosphonic acid, the sodium and potassium salts of ethane 1-hydroxy-1,1-diphospbonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, all of which are incorporated herein by reference.

Examples of nonphosphorus, inorganic builders are tetraborate decahydrate and silicates having a weight ratio of $SiO_2$ to alkali metal oxide of from about 0.5 to about 4.0, preferably from about 1.0 to about 2.4. Water-soluble, nonphosphorus organic builders useful herein include the various alkali metal, ammonium and substituted anmmonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Polymeric polycarboxylate builders are set forth in U.S. Pat. No. 3,308,067, Diehl, issued Mar. 7, 1967, the disclosure of which is incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylene malonic acid. Some of these materials are useful as the water-soluble anionic polymer as hereinafter described, but only if in intimate admixture with the non-oap anionic surfactant.

Other suitable polycarboxylates for use herein are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al, both of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a detergent composition. Particularly preferred polycarboxylate builders are the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Bleaching agents and activators are described in U.S. Pat. No. 4,412,934, Chung et al., issued Nov. 1, 1983, and in U.S. Pat. No. 4,483,781, Hartman, issued Nov. 20, 1984, both of which are incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. No. 3,933,672, issued Jan. 20, 1976 to Bartoletta et al., and U.S. Pat. No. 4,136,045, issued Jan. 23, 1979 to Gault et al., both incorporated herein by reference.

Suitable smectite clays for use herein are described in U.S. Pat. No. 4,762,645, Tucker et al, issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al, issued May 5, 1987, both incorporated herein by reference.

In order to make the present invention more readily understood, reference is made to the following examples, which are intended to be illustrative only and not intended to be limiting in scope.

EXAMPLES I–IV

The following examples illustrate various compositions within the scope of the invention.

| | (% Weight) | | | |
|---|---|---|---|---|
| | I | II | III | IV |
| Base Granule | | | | |
| $C_{14-15}$ alkyl sulfate | 1.8 | 0.7 | 1.3 | 1.8 |
| $C_{12}$ linear alkylbenzene sulfonate | 15.8 | 16.8 | 16.2 | 15.5 |
| $C_{14-15}$ alkyl ethoxy sulfate (EO = 2.25) | 0.7 | 0.7 | 0.6 | 0.7 |
| $C_{12-14}$ dimethyl hydroxyethyl quaternary ammonium chloride | 0.3 | 0.3 | 0.4 | 0.6 |
| $C_{12-13}$ alkyl ethoxylate (EO = 9) | 0.5 | 0.5 | 0.5 | 0.5 |
| Sodium sulfate | 28.2 | 28.2 | 28.2 | 28.2 |
| Brightener | 0.1 | 0.1 | 0.1 | 0.1 |
| Sodium silicate | 1.0 | 1.0 | 1.0 | 1.0 |
| Polyethylene glycol (MW = 4000) | 1.2 | 1.2 | 1.2 | 1.2 |
| Sodium polyacrylate (MW = 4500) | 2.4 | 2.4 | 2.4 | 2.4 |
| Sodium perborate | 0.7 | 0.7 | 0.7 | 0.7 |
| Sodium nonanoyloxybenzene sulfonate | 0.7 | 0.7 | 0.7 | 0.7 |
| Aluminosilicate | 25.8 | 25.8 | 25.8 | 25.8 |
| Admix/Spray-On | | | | |
| Protease enzyme[1] | 0.2 | 0.2 | 0.2 | 0.2 |
| Cellulase enzyme[2] | 0.1 | 0.1 | 0.1 | 0.1 |
| Misc. (water and minors) | Bal. | Bal. | Bal. | Bal. |
| | 100.0 | 100.0 | 100.0 | 100.0 |

[1]FN3 commercially sold by Genencor, Inc..
[2]CAREZYME ® commercially sold by Novo Nordisk.

The compositions exemplified above are made by combining the base granules ingredients as a slurry, and spray drying to a low level of residual moisture. The remaining dry ingredients are admixed in granular form with the spray-dried granules in a rotary mixing drum and the liquid ingredients are sprayed onto the resulting granules to form the finished granular detergent composition. Alternatively, the ingredients can be agglomerated in one or more mixers to form detergent base agglomerates which are then admixed with other ingredients that can include spray-dried granules such as those exemplified herein. All of the exemplified detergent compositions unexpectedly have improved cleaning performance and wash water solubility.

Having thus described the invention in detail, it will be clear to those skilled in the art that various changes may be made without departing from the scope of the invention and the invention is not to be considered limited to what is described in the specification.

What is claimed is:

1. A granular detergent composition characterized by:

(a) from 1% to 90% by weight of a surfactant system including (i) acyclic quaternary ammonium salt surfactant and linear alkylbenzene sulfonate surfactant in a molar ratio range of from 1:8 to 1:72, wherein said quaternary ammonium salt surfactant has the formula

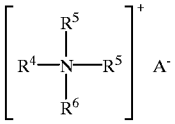

wherein $R^4$ is an acyclic aliphatic $C_{10}$–$C_{22}$ hydrocarbon group, $R^5$ is $R^4$ or $C_1$–$C_4$ saturated alkyl or hydroxy alkyl groups, and $R^6$ is $R^4$ or $R^5$ and $A^-$ is an anion;

(ii) alkyl sulfate surfactant in a molar ratio range with said linear alkylbenzene sulfonate surfactant of from 1:3 to 1:20;

(iii) alkyl ethoxy sulfate surfactant in a molar ratio range with said linear alkylbenzene sulfonate surfactant of from 1:15 to 1:42, wherein said alkyl ethoxy sulfate surfactant has a degree of ethoxylation of from 1 to 5;

(b) at least 1% by weight of a detergency builder; and (c) the balance adjunct detergent ingredients.

2. A detergent composition according to claim 1 wherein said linear alkylbenzene sulfonate surfactant is $C_{10-18}$ linear alkylbenzene sulfonate.

3. The detergent composition of claim 1 wherein $R^4$ is an acyclic aliphatic $C_{12}$–$C_{14}$ hydrocarbon group, $R^5$ is a methyl group, $R^6$ is a hydroxyethyl group and $A^-$ is a chloride anion.

4. The detergent composition of claim 1 wherein said surfactant system further includes alkyl ethoxylate in a molar ratio range with said linear alkylbenzene sulfonate surfactant of from 1:1 to about 1:24.

5. The detergent composition of claim wherein said alkyl ethoxylate is $C_{12-13}$ alkyl ethoxylate with a degree of ethoxylation of from about 2 to about 9.

6. The detergent composition of claim 1 wherein said adjunct detergent ingredients are selected from the group consisting of bleaching agents, bleach activators, enzymes, polymeric anti-redeposition agents, polymeric dispersants, polymeric soil release agents, chelants, perfumes, dye transfer inhibitors and mixtures thereof.

7. The detergent composition of claim 1 wherein said molar ratio range of said quaternary ammonium salt surfactant to said linear alkylbenzene sulfonate surfactant is from about 1:10 to about 1:63.

8. The detergent composition of claim 1 wherein said molar ratio range of said alkyl sulfate surfactant to said linear alkylbenzene sulfonate surfactant is from about 1:5 to about 1:15.

9. The detergent composition of claim 1 wherein the molar ratio of said linear alkylbenzene sulfonate surfactant to the sum of said alkyl sulfate surfactant, said alkyl ethoxy sulfate surfactant and said quaternary ammonium salt surfactant is about 1:1.

10. The detergent composition of claim 1 wherein said molar ratio range of said alkyl ethoxy sulfate surfactant to said linear alkylbenzene sulfonate surfactant is from about 1:20 to about 1:35.

11. A granular detergent composition comprising:

(a) from about 5% to about 40% by weight of a surfactant system including (i) acyclic quaternary ammonium salt surfactant and linear alkylbenzene sulfonate surfactant in a molar ratio of from about 1:10 to about 1:63, wherein said quaternary ammonium salt surfactant has formula

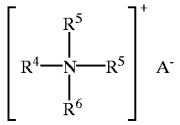

wherein $R^4$ is an acyclic aliphatic $C_{10}$–$C_{22}$ hydrocarbon group, $R^5$ is $R^4$ or $C_1$–$C_4$ saturated alkyl or hydroxy alkyl groups, and $R^6$ is $R^4$ or $R^5$ and $A^-$ is an anion;

(ii) alkyl sulfate surfactant in a molar ratio range with said linear alkylbenzene sulfonate surfactant of from about 1:5 to about 1:15;

(iii) alkyl ethoxy sulfate surfactant in a molar ratio range with said linear alkylbenzene sulfonate surfactant of from about 1:20 to about 1:35, wherein said alkyl ethoxy sulfate surfactant has a degree of ethoxylation of from about 1 to 5;

(b) from about 10% to about 70% by weight of a detergency builder; and (c) the balance adjunct detergent ingredients.

12. The detergent composition of claim 11 wherein said linear alkylbenzene sulfonate surfactant is $C_{10-18}$ linear alkylbenzene sulfonate.

13. The detergent composition of claim 11 wherein $R^4$ is an acyclic aliphatic $C_{12}$–$C_{14}$ hydrocarbon group, $R^5$ is a methyl group, $R^6$ is a hydroxyethyl group and $A^-$ is a chloride anion.

14. The detergent composition of claim 11 wherein said surfactant system further includes alkyl ethoxylate in a molar ratio range with said linear alkylbenzene sulfonate surfactant of from 1:1 to about 1:24.

15. The detergent composition of claim 14 wherein said alkyl ethoxylate is $C_{12-13}$ alkyl ethoxylate with a degree of ethoxylation of from about 2 to about 9.

16. The detergent composition of claim 11 wherein said adjunct detergent ingredients are selected from the group consisting of bleaching agents, bleach activators, enzymes, polymeric anti-redeposition agents, polymeric dispersants, polymeric soil release agents, chelants, perfumes, dye transfer inhibitors and mixtures thereof.

17. The detergent composition of claim 11 wherein the molar ratio of said linear alkylbenzene sulfonate surfactant to the sum of said alkyl sulfate surfactant, said alkyl ethoxy sulfate surfactant and said quaternary ammonium salt surfactant is about 1:1.

18. The detergent composition of claim 11 wherein the molar ratio of said linear alkylbenzene sulfonate surfactant to the sum of said alkyl sulfate surfactant, said alkyl ethoxy sulfate surfactant and said quaternary ammonium salt surfactant is greater than about 1:1.

19. A method of laundering soiled clothes comprising the step of contacting said clothes with an effective amount of a granular detergent composition according to claim 1 in an aqueous solution.

20. A method of laundering soiled clothes comprising the step of contacting said clothes with an effective amount of a granular detergent composition according to claim 11 in an aqueous solution.

* * * * *